US011408163B2

(12) United States Patent
Chen et al.

(10) Patent No.: US 11,408,163 B2
(45) Date of Patent: Aug. 9, 2022

(54) FLOOR DRAIN

(71) Applicants: Wei Chen, Shenzhen (CN); Hao Chen, Shenzhen (CN)

(72) Inventors: Wei Chen, Shenzhen (CN); Hao Chen, Shenzhen (CN)

( * ) Notice: Subject to any disclaimer, the term of this patent is extended or adjusted under 35 U.S.C. 154(b) by 131 days.

(21) Appl. No.: 16/899,621

(22) Filed: Jun. 12, 2020

(65) Prior Publication Data

US 2020/0308818 A1 Oct. 1, 2020

Related U.S. Application Data

(63) Continuation-in-part of application No. PCT/CN2018/120328, filed on Dec. 11, 2018.

(30) Foreign Application Priority Data

Dec. 12, 2017 (CN) ..... 201711315113.0
Dec. 12, 2017 (CN) ..... 201721718369.1

(51) Int. Cl.
*E03F 5/04* (2006.01)

(52) U.S. Cl.
CPC ..... *E03F 5/0407* (2013.01); *Y10T 137/6988* (2015.04)

(58) Field of Classification Search
CPC ..... E03F 5/0407; E03F 2005/0417; Y10T 137/6988
See application file for complete search history.

(56) References Cited

U.S. PATENT DOCUMENTS 2,758,664 A * 8/1956 Koenig ..... F16K 31/22 137/433
3,107,687 A * 10/1963 Howe ..... E03F 5/042 137/362
6,626,201 B1 * 9/2003 Kim ..... E03F 5/042 137/1
6,719,004 B2 * 4/2004 Huber ..... E03F 5/0407 137/850
2008/0072967 A1 * 3/2008 Wen ..... E03F 5/042 137/362

FOREIGN PATENT DOCUMENTS

GB 2278372 A * 11/1994 ..... E03F 5/0407

* cited by examiner

*Primary Examiner* — Kevin F Murphy
(74) *Attorney, Agent, or Firm* — Matthias Scholl P.C.; Matthias Scholl

(57) ABSTRACT

A drain floor, including a drain base, a drain body including a cavity, a drain cup, a supporting frame; and a reset member. The drain cup includes a cup body, a stem, and a base. The cup body includes a through hole, and two ends of the stem are connected to the cup body and the base, respectively. The cup body is disposed in the cavity and the base is disposed out of the cavity. The space between the drain body and the drain cup forms an annular channel, and the annular channel communicates with the through hole. The annular channel includes a water inlet and a water outlet. The reset member is connected to the drain cup and is movable with respect to the drain cup to open and close the water outlet. The supporting frame connects the drain body and the reset member.

18 Claims, 22 Drawing Sheets

FLOOR DRAIN

CROSS-REFERENCE TO RELATED APPLICATIONS

This application is a continuation-in-part of International Patent Application No. PCT/CN2018/120328 with an international filing date of Dec. 11, 2018, designating the United States, now pending, and further claims foreign priority benefits to Chinese Patent Application No. 201711315113.0 filed Dec. 12, 2017, and to Chinese Patent Application No. 201721718369.1 filed Dec. 12, 2017. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a floor drain.

A floor drain is a plumbing fixture installed in the floor of a structure, and mainly designed to remove water near it. Known floor drains are sealed mechanically or by water, and the former includes a drain body including a cavity, a reset member, and a sealing base. The drain body is fixed on the floor and sealed via the sealing base. The cavity collects the water flowing from the floor and the reset member controls the opening and closing of the drain body to drain the water out of the cavity.

SUMMARY

The disclosure provides a floor drain comprising a drain base, a drain body comprising a cavity, a drain cup disposed in the cavity, a supporting frame, and a reset member.

The drain base is secured to the floor of a structure. The drain body is integrated with the drain base, or is detachably connected to the drain base. The cavity of the drain body is a part of water passage, and the lower end of the drain body and the base of the drain cup defines a water drain valve.

The drain cup is disposed in the cavity of the drain body. The drain cup comprises a cup body, a stem, and a base. The cup body comprises a lower end provided with a through hole, and two ends of the stem are connected to the cup body and the base, respectively. The base functions as a bottom seal. When the floor drain is closed, the upper surface of the base is in a sealed connection to the lower end of the drain body. When the floor drain is opened, a gap occurs between the upper surface of the base and the lower end of the drain body, and the water in a floor is drained out of the drain body from the gap. The reset member is connected to the drain cup and is movable with respect to the drain cup to open and close the floor drain.

The stem disposed between the cup body and the base to support the cup body can be an independent part, or a part attached to the cup body or the base. The height of the stem determines the size of the gap between the upper surface of the base and the lower end of the cup body.

The supporting frame connects the drain body and the reset member connecting to the drain cup, and thus the drain cup is indirectly supported by the supporting frame.

The reset member is a driving mechanism controlling the opening and closing of the drain body. The reset member comprises a spring or a magnet or a combination thereof.

The driving force of the reset member can be an elastic force of the spring, or a magnetic force of the magnet.

The supporting frame can comprise a guide plate or a grooved guide plate. The supporting frame can be integrated with the drain body. The drain body and the cup body of the drain cup can be round or other shapes.

The vertical projected area of the cup body is greater than the vertical projected area of the base, so that the weight of the storage water in the cup body is greater than the upward force acting on the base, thereby increasing the downward force exerting on the drain cup, improving the stability of the water flow and the drainage capacity of the floor drain.

The inner surface of the drain body and the outer surface of the drain cup form an annular channel. When the floor drain is opened, the gap between the upper surface of the base and the lower end of the drain body is a drainage outlet of the floor drain, and the flow area of the drainage outlet is larger than that of the annular channel, thereby increasing the downward force exerting on the base of the drain cup, improving the stability of the drainage outlet and the drainage capacity of the floor drain.

The cup body comprises a straight part and a contraction part disposed between the straight part and the stem. The diameter of the lower part of the drain body and the diameter of the contraction part of the cup body gradually decrease from the cup body to the base, thereby reducing the resistance to the water flow, and improving the drainage capacity of the floor drain.

In certain embodiments, no device is disposed above the annular channel formed by the inner surface of the drain body and the outer surface of the drain cup. The water directly falls into the annular channel.

In certain embodiments, the guide plate is disposed above the annular channel formed by the inner surface of the drain body and the outer surface of the drain cup, so that the water cannot fall into the annular channel and is guided into the cup body of the drain cup. Thus, the weight of the water in the cup body can overcome the upward force exerting on the base by the drainage pipe connecting to the floor drain, thus improving the drainage capacity of the floor drain.

The grooved guide plate is disposed above the cup body and comprises an annular water collector and a guide channel disposed on the annular water collector. The guide channel comprises a first flange and the annular water collector comprises a second flange. The first flange of the guide channel comprises a plurality of openings. The guide channel is disposed above the annular channel formed by the inner surface of the drain body and the outer surface of the drain cup, so that the water cannot fall into the annular channel and is guided into the cup body of the drain cup via the openings of the guide channel.

The reset member comprises a driving shaft. The supporting frame comprises a cantilever. The driving shaft passes through the axis of the drain cup and is fixed on the cantilever.

The driving shaft comprises a first shaft provided with a female fastener and a second shaft provided with a male fastener. When the male fastener is locked in the female fastener, the first shaft is integrated with the second shaft.

The drain cup comprises a sleeve surrounding the female fastener of the first shaft. A second spring is wrapped around the second shaft. The second spring can drive the second shaft to secure to the first shaft. When the first shaft is integrated with the second shaft, the sleeve is wrapped around the female fastener, ensuring the stability of the drain cup.

The supporting frame comprises a plurality of circumferentially disposed hanging hooks. The cup body can be secured to the supporting frame via the plurality of circumferentially disposed hanging hooks.

The drain base comprises a plurality of circumferentially disposed lugs, and the drain body comprises a plurality of circumferentially disposed slots. The plurality of circumferentially disposed lugs is respectively disposed in the plurality of circumferentially disposed slots, thereby fixing the drain body on the drain base.

The drain body comprises an outer edge provided with a pressure plate. One end of the pressure plate is provided with a sealing ring. The sealing ring is in a sealed connection to the drain base.

Figure 1A:
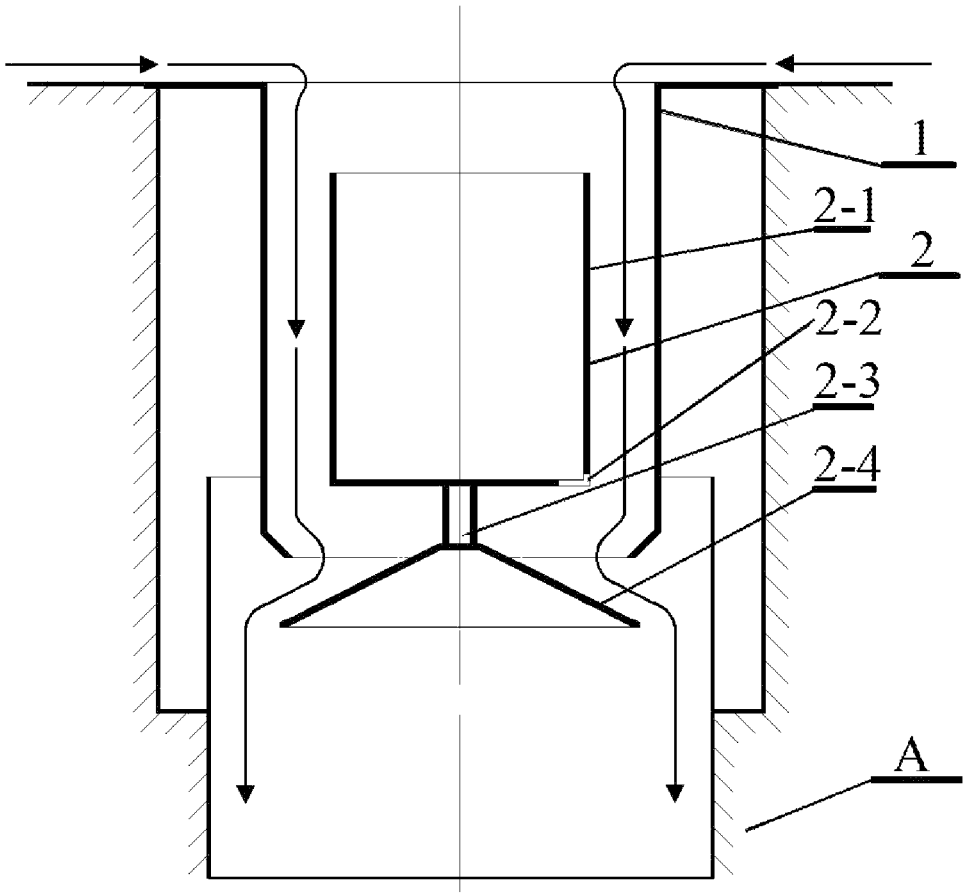
FIG. 1A is a schematic diagram showing a waterflow direction of a floor drain without a guide plate according to one embodiment of the disclosure.

In the drawings, the following reference numbers are used: 1. Drain body; 1-1. Slot; 1-2. Mounting hole; 1-3. Pressure plate; 1-4. Sealing ring; 2. Drain cup; 2-1. Cup body; 2-1-0. Sleeve; 2-2. Through hole; 2-3. Stem; 2-4. Base; 3. Supporting frame; 3-1. Supporting ring; 3-2. Cantilever; 3-3. Spring seat; 3-4. Guide plate; 3-5. Annular water collector; 3-6. Guide channel; 3-7. Hanging hook. 4. Sealing cover; 5. Grate; 6. Drain base; 6-1. Lug; 7. Sealing rubber ring; 8. Reset member; 8-1. First spring; 8-2. First shaft; 8-2-1. Clamping portion; 8-2-2. Counterbore portion; 8-2-3. Narrow groove; 8-3. Second shaft; 8-3-1. Connection rod; 8-3-2. Connector; 8-4. Second spring.

DETAILED DESCRIPTION OF THE EMBODIMENTS

To further illustrate the disclosure, embodiments detailing a floor drain are described below. It should be noted that the following embodiments are intended to describe and not to limit the disclosure.

Figure 13:
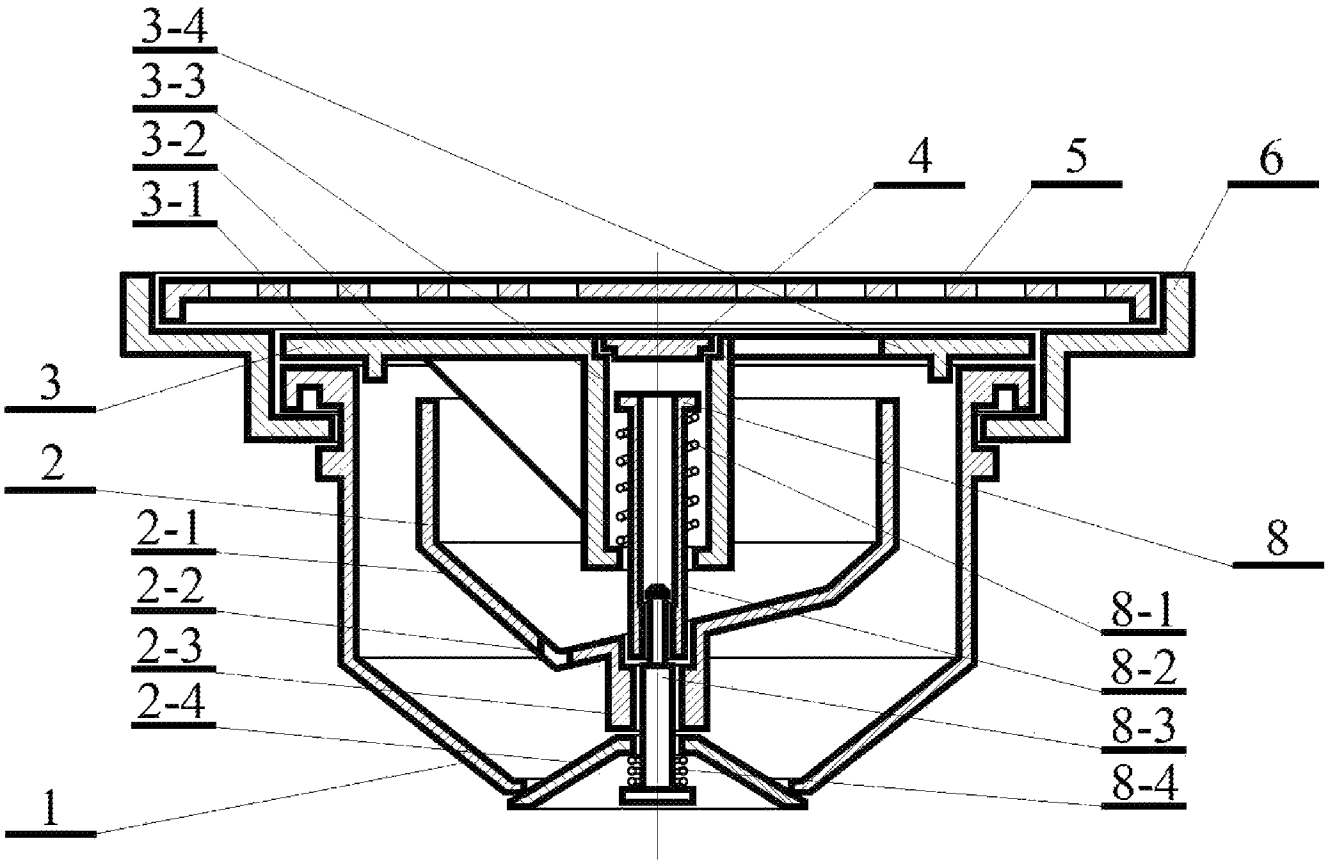
FIG. 13 is a schematic diagram of a floor drain according to one embodiment of the disclosure.

Referring to FIG. 13, a floor drain comprises a drain body 1 comprising a cavity, a drain cup 2 disposed in the cavity of the drain body 1, a supporting frame 3, a reset member 8, and a drain base 6. The drain cup 2 comprises a cup body 2-1 provided with a through hole 2-2, a stem 2-3, and a base 2-4. The base 2-4 functions as a bottom seal. The stem 2-3 is disposed between the cup body 2-1 and the base 2-4 to decide the gap between the cup body 2-1 and the base 2-4. The supporting frame 3 comprises a supporting ring 3-1, a cantilever 3-2, a spring seat 3-3, a guide plate 3-4, and a hanging hook 3-7. The supporting frame 3 connects to the drain base 6 and the reset member 8.

The reset member 8 is connected to the drain cup 2 and controls the opening and closing of the drain body. The reset member 8 comprises a first spring 8-1, a first shaft 8-2, a second shaft 8-3, and a second spring 8-4. The first spring 8-1 is wrapped around one end of the first shaft 8-2, and the other end is connected to the second shaft 8-3. The second shaft 8-3 is fixed on the lower end of the drain cup 2. The drain cup 2 is supported by the spring seat 3-3.

When the water in the floor of a structure enters the floor drain via a grate 5, the water is guided by the guide plate 3-4 and enters the cup body 2-1. Thus, the cup body 2-1 is filled with water. The maximum water volume in the cup body 2-1 is constant, so that the weight of the storage water overcomes the upward force of the first spring 8-1, and presses the drain cup 2 down to the lowest point of the first spring 8-1. Thus, the flow area of the drainage outlet of the floor drain, that is, the gap between the upper surface of the base 2-4 and the lower end of the drain body 1, reaches the maximum.

When no water exists on the floor, the water flows out of the cup body 2-1 via the through hole 2-2 to an annular channel comprising a water inlet and a water outlet; the water outlet is a drainage outlet disposed on the lower end of the drain body. The water volume of the cup body gradually decreases, so that the drain cup 2 moves upward under the elastic force of the first spring 8-1. When no water remains in the cup body 2-1, the upper surface of the base 2-4 directly contacts the lower end of the drain body 1 to form a bottom seal. The elastic force of the first spring 8-1 is exerted to the bottom seal, ensuring the sealing of the floor drain.

The drain body 1 is disposed on the drain base 6, and the inner surface of the drain body 1 and the outer surface of the drain cup 2 form the annular channel. The drainage outlet refers to the gap between the upper surface of the base 2-4 and the lower end of the drain body 1. When the water continually flows into the floor drain, the drain cup 2 moves to its lowest point. The height of the stem 2-3 determines the size of the gap between the upper surface of the base 2-4 and the lower end of the cup body 2-1. Specifically, the first section of the gap is an end part of the annular channel, and the second section of the gap is the drainage outlet of the floor drain. In the drainage process, the water first enters the floor drain via the grate 5, flows along the guide plate 3-4 and the annular channel, and drains out from the drainage outlet.

Figure 2:
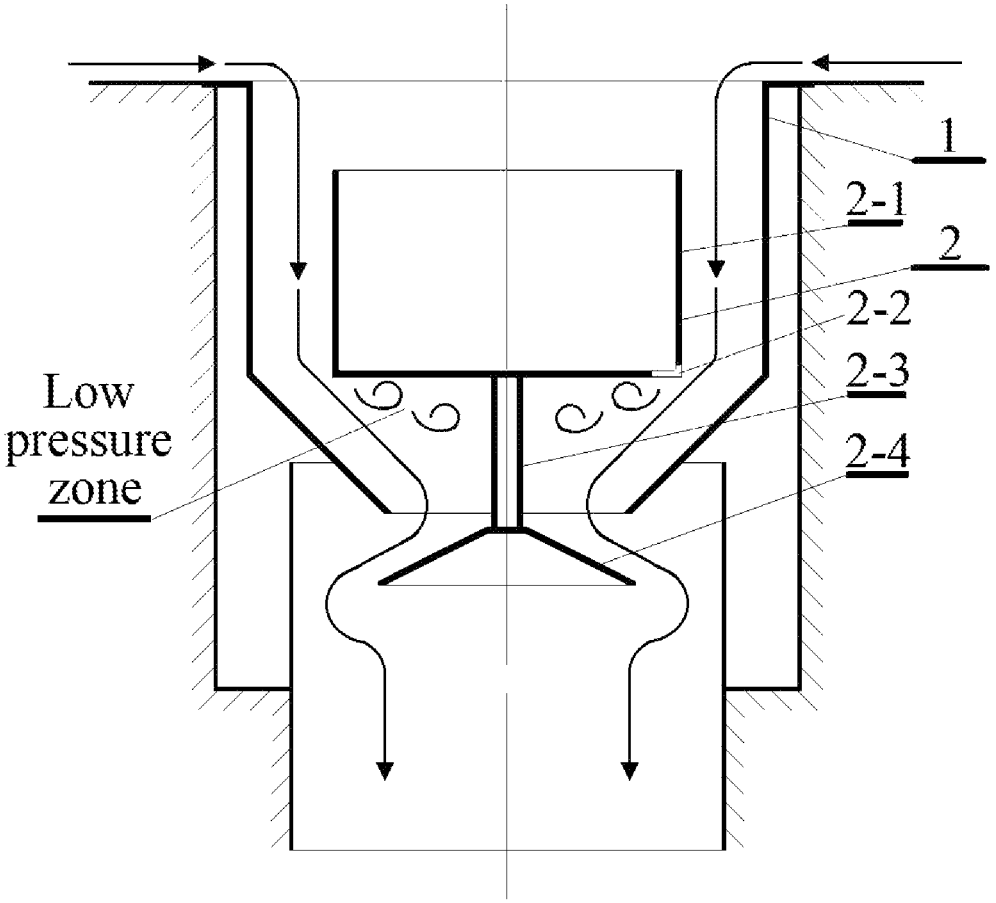
FIG. 2 is a schematic diagram of a floor drain according to one embodiment of the disclosure.

FIG. 2 shows a floor drain comprising a drain cup. Specifically, the vertical projected area of the cup body 2-1 is more than twice that of the base 2-4. When the water in the floor of a structure enters the floor drain, the drain cup 2 is subject to three forces including the weight of the water in the cup body 2-1, a pressure difference between the upper and lower surfaces of the cup body 2-1, and an impact force of the water flow of the lower end of the drain body exerting on the upper surface of the base 2-4.

In the drainage state, the water flows through the annular channel between the drain body 1 and the cup body 2-1, and drains out from the gap formed by the lower end of the drain body 1 and the upper surface of the base 2-4. When the water flows in the annular channel, a vortex is generated on the bottom surface of body 2-1, thereby forming a low-pressure area. The pressure P acting on the cup body 2-1 is calculated as follows:

$$P=(p_t-p_b)\times A$$

where $p_t$ is the pressure acting on the upper surface, and $p_b$ is the pressure acting on the lower surface, and A is the vertical projected area of the cup body 2-1. The pressure P acting on the cup body 2-1 is proportional to the vertical projected area A of the cup body 2-1.

According to the Law of Conservation of Momentum, the impact force F acting on the base 2-4 is calculated using the formula: $F=M\times U$, where M is the mass of water, and U is the flow speed of the water. The mass M of the water is calculated using the formula: $M=Q\times\rho$, where Q is the volume of the water, and ρ is the density of the water. The flow speed U of the water is calculated using the formula: $U=Q/S$, where S is the area of the drainage outlet at the lower end of the drain body 1. Therefore, $F=Q^2\rho/S$. At the same water volume, the area S of the drainage outlet is inversely proportional to the impact force F acting on the base 2-4. The smaller area S of the drainage outlet also leads to a smaller surface area of the base 2-4, so when the drainage pipe exerts a reacting force to the base in the drainage process, because the base has a relatively small surface area, the upward force exerting on the base 2-4 is relatively small.

In certain embodiments of the disclosure, the vertical projected area of the cup body 2-1 is much greater than the vertical projected area S of the base 2-4, thereby effectively increasing the downward force exerting on the drain cup 2, and facilitating the opening of the floor drain and improving the drainage capacity of the floor drain.

Figure 4:
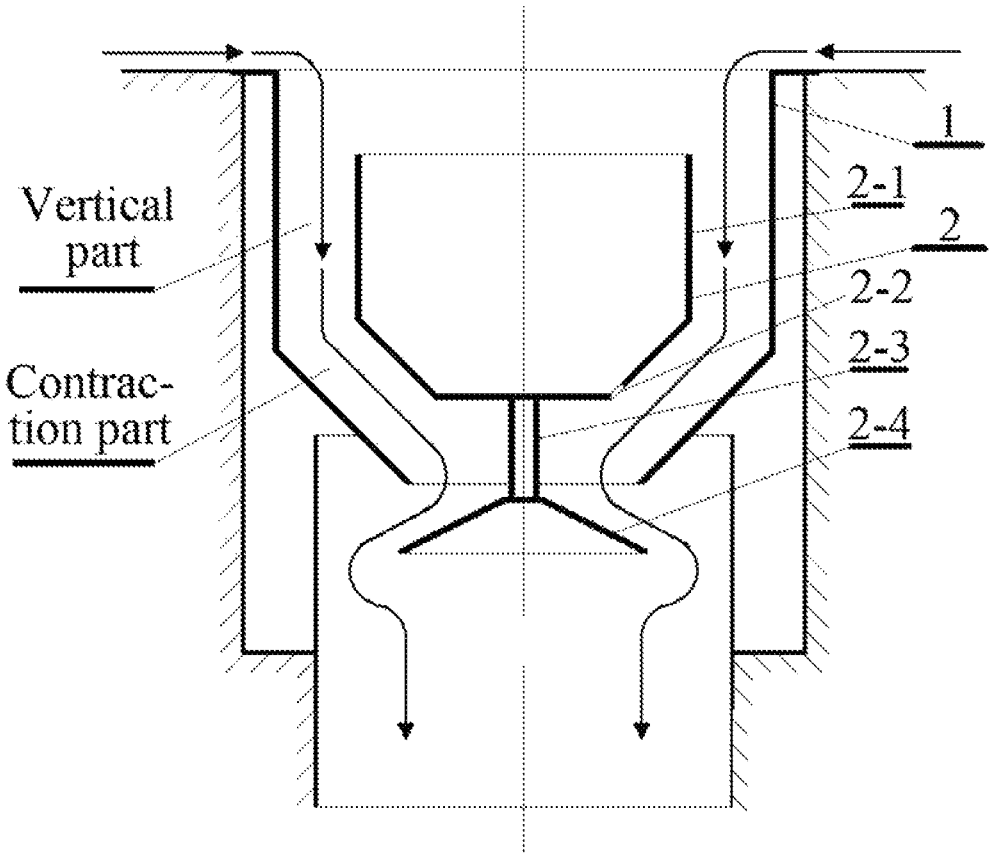
FIG. 4 is a schematic diagram of a floor drain comprising a contracted drain body according to still another embodiment of the disclosure.

In certain embodiments of the disclosure, as shown in FIG. 4, the cup body comprises a first straight part and a first contraction part disposed between the straight part and the stem; the drain body comprises a second straight part parallel to the first straight part and a second contraction part parallel to the second contraction part. Thus, the annular channel is widened in the lower part of the drain body. That is to say, the annular channel comprises a straight part and a contracted part, thus reducing the flowing resistance of the water, so that the sludge contained in the water can be discharged.

As needed, a guide plate 3-4 is disposed on the supporting frame 3 to guide the water into the cup body. The water accumulated in the cup body can exert a downward force on the drain cup and offset the pressure from the drainage pipe.

Figure 5:
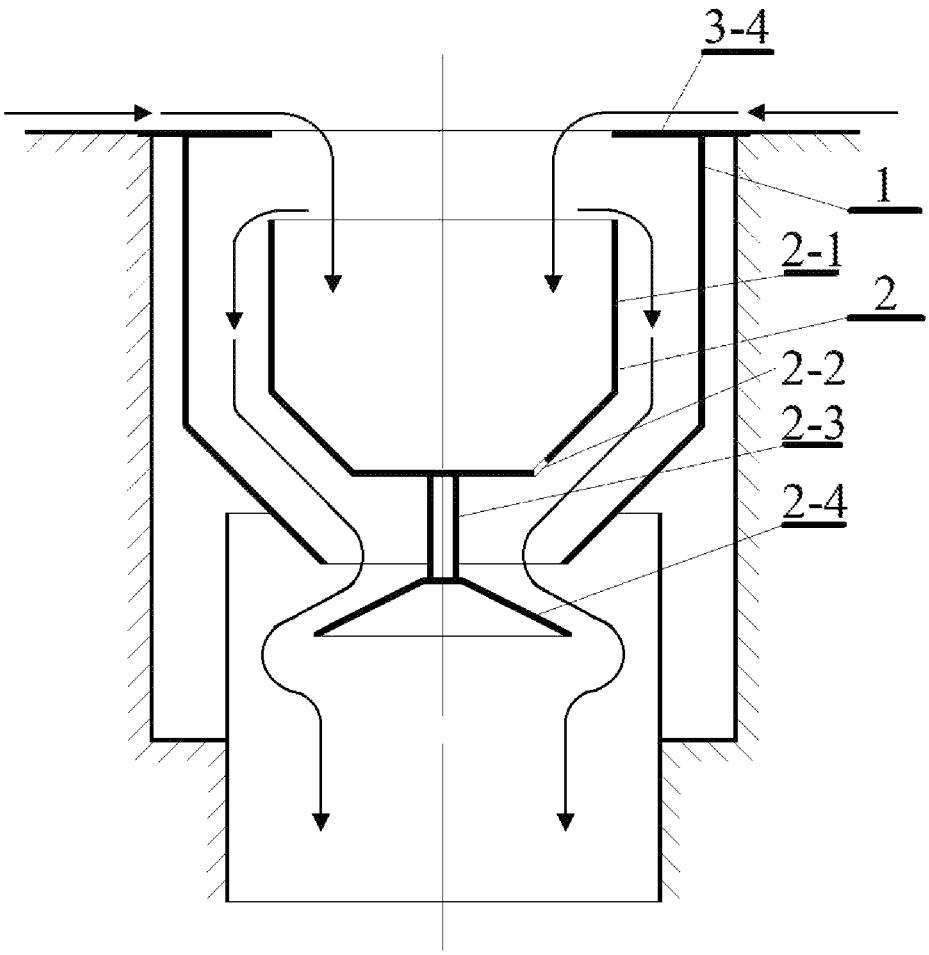
FIG. 5 is a schematic diagram of a floor drain comprising a guide plate according to still another embodiment of the disclosure.

FIG. 5 shows a floor drain comprising a guide plate. For a floor drain comprising a relatively large-sized water inlet, although the arrangement of the guide plate reduces the flow area of the water inlet, the drainage capacity of the floor drain is hardly affected. The water is guided via the guide plate 3-4 to the cup body 2-1 of the floor drain. The maximum volume G of the storage water is calculated using the formula: $G=A\times h$, where A is the vertical projected area of the cup body 2-1, and h is the height of the cup body 2-1. In the drainage process, the drainage pipe exerts an upward force, that is, a reacting force, on the base of the drain cup 2, and the upward force is the product of the vertical projected area S of the base 2-4 and the pressure in the drainage pipe. In the embodiment, the vertical projected area A of the cup body 2-1 is greater than the vertical projected area S of the base 2-4, so that the maximum weight of the storage water in the cup body 2-1 is greater than the upward force, keeping the floor drain in an open state.

Figure 6A:
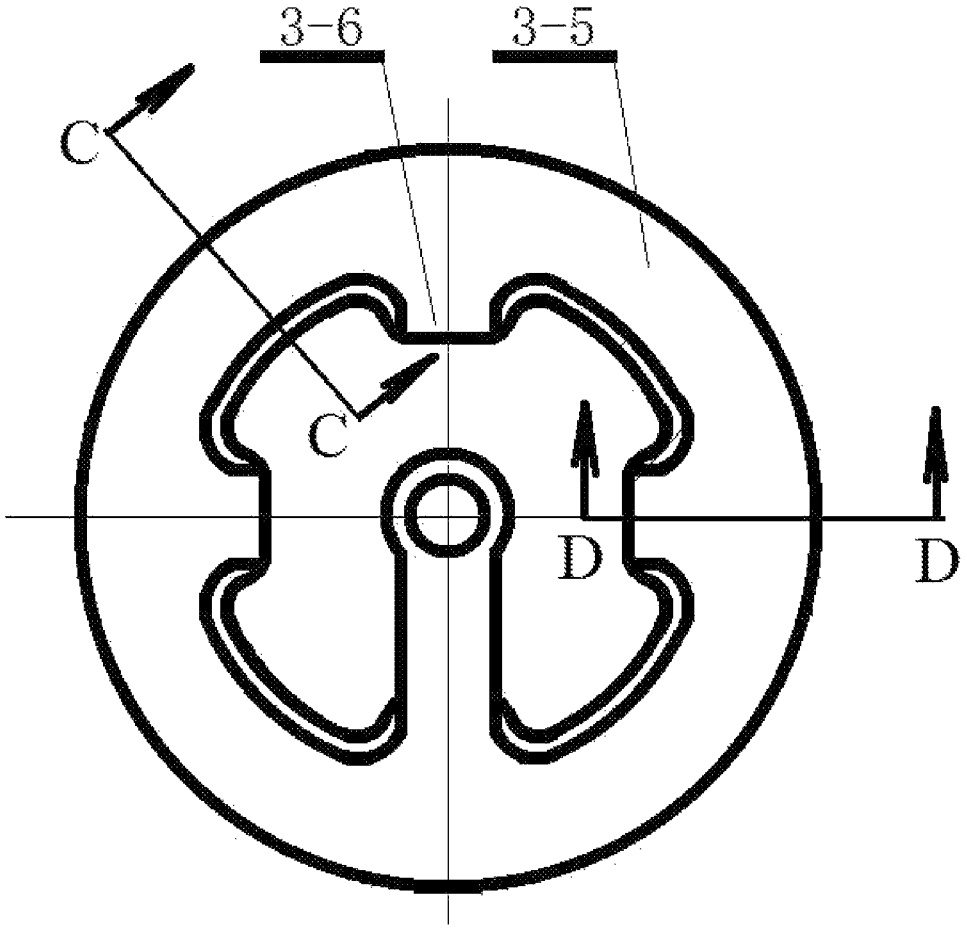
FIG. 6A is a top view of a grooved guide plate.
Figure 6B:
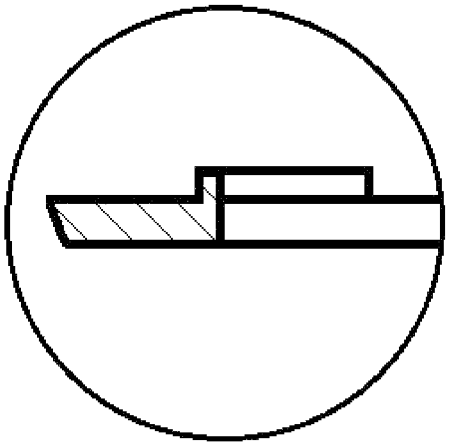
FIG. 6B is a sectional view of an annular water collector.
Figure 6C:
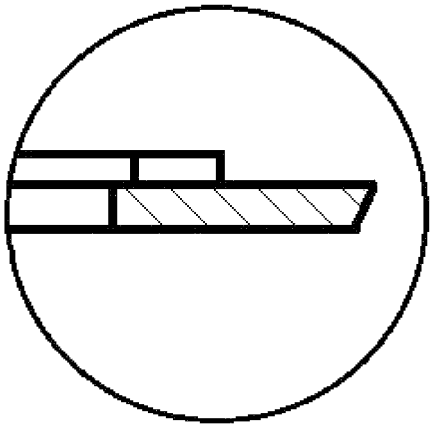
FIG. 6C is a sectional view of a guide channel.

In certain embodiments of the disclosure, the guide plate can be replaced with a grooved guide plate as shown in FIG. 6A. The grooved guide plate comprises an annular water collector 3-5 and a guide channel 3-6. FIG. 6B is a cross sectional view of the annular water collector 3-5 taken from line C-C in FIG. 6A. FIG. 6C is a cross sectional view of the guide channel 3-6 taken from line D-D in FIG. 6A. FIG. 6A is a schematic diagram of a grooved guide plate comprising four guide channels 3-6. The guide channel comprises a first flange and the annular water collector comprises a second flange. The second flange allows a small amount of water to flow into the annular water collector 3-5, down through the guide channel 3-6, and into the cup body 2-1. When there is a large amount of water flow, the water can overpass the first flange of the guide channel 3-6 and the second flange of the annular water collector 3-5 and fall into the annular channel between the inner surface of the drain body and the outer surface of the drain cup.

The drain base 6 is fixedly disposed on the ground and supports the entire floor drain. The water enters the grate 5, flows through the drain base 6, the supporting ring 3-1 of the supporting frame 3 and the guide plate 3-4, and into the cup body 2-1. When the cup body 2-1 is filled with water, the excess water overpasses the cup body wall and flows through the annular water collector, and drains out from the drainage outlet. In certain embodiments, the floor drain has a relatively large-sized water inlet, so that the water flow is large, and the base of the drain cup 2 receives a downward impact force resulting from the flowing of the water, thereby increasing the flow area of the channel and improving the drainage capacity of the floor drain.

Figure 7A:
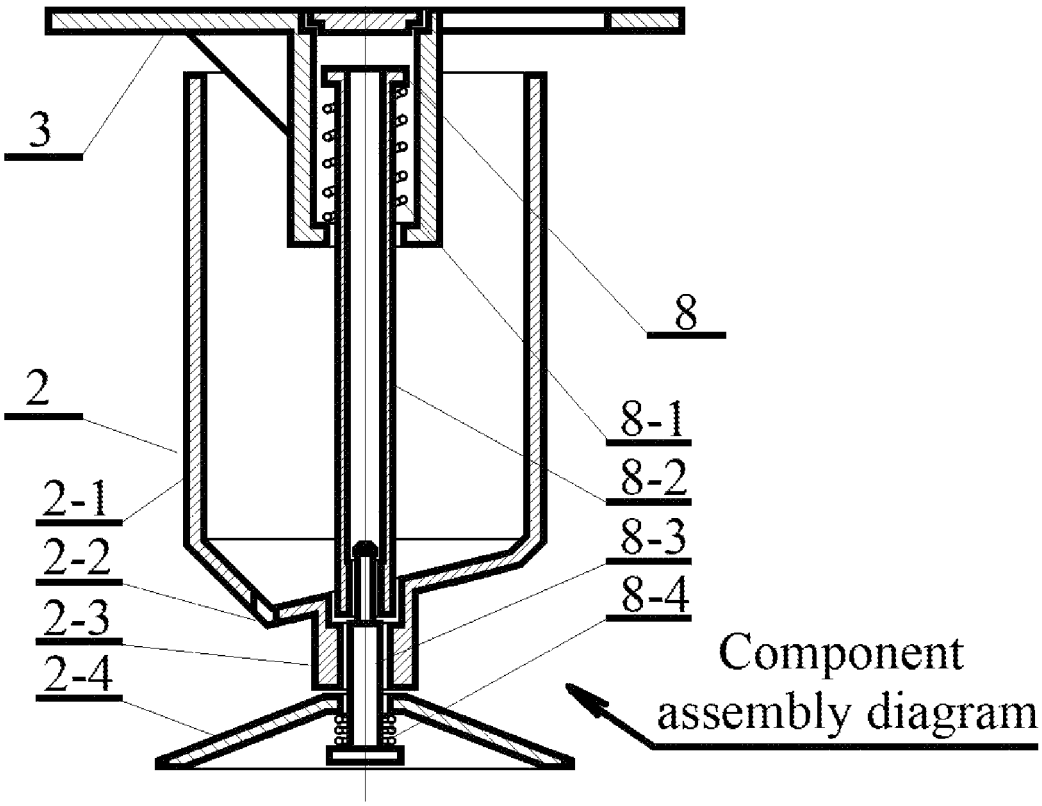
FIG. 7A is an assembly diagram of a drain cup, a supporting frame and a reset member according to one embodiment of the disclosure.
Figure 7B:
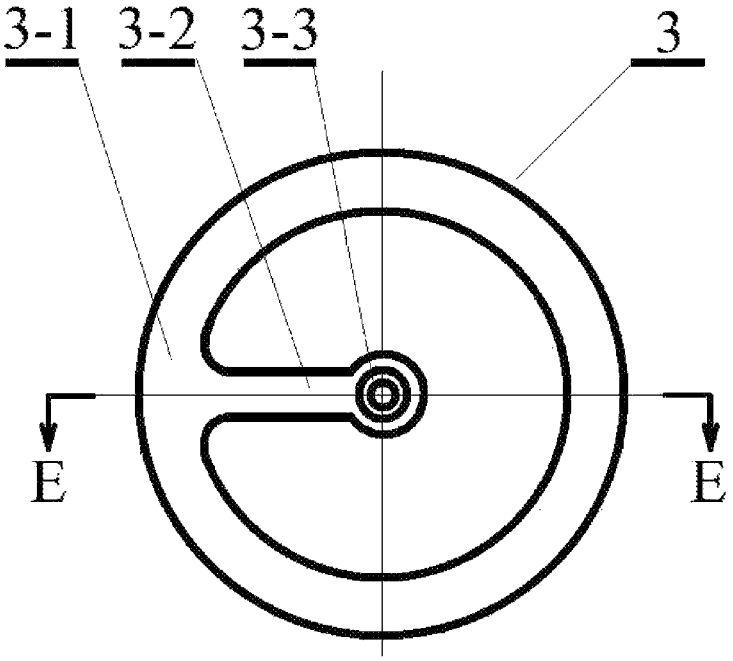
FIG. 7B is a top view of a supporting frame.
Figure 7C:
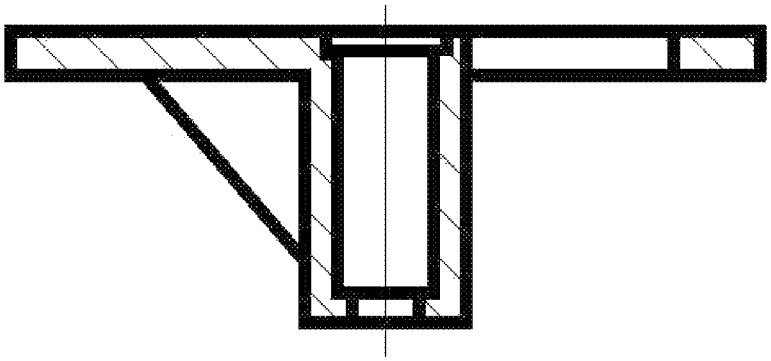
FIG. 7C is a section view of the supporting frame taken from line E-E in FIG. 7B.

Referring to FIGS. 7A-7C, the reset member comprises a first spring 8-1, a first shaft 8-2, s second shaft 8-3, and a second spring 8-4. The drain cup is supported by the supporting frame 3. The supporting frame 3 comprises the supporting ring 3-1, the cantilever 3-2 and the spring seat 3-3. The first spring 8-1 is fixedly disposed on the spring seat 3-3. The first shaft 8-2 and the second shaft 8-3 form a driving shaft and support the drain cup 2. The cantilever 3-2 connects the spring seat 3-3 and the supporting ring 3-1, as shown in FIG. 7B. The drain cup 2 is fixedly disposed on the driving shaft penetrating through the axis of the drain cup 2. The driving shaft comprises the first shaft 8-2 and the second shaft 8-3. The supporting frame 3 comprises the supporting ring 3-1, the cantilever 3-2 connected to the supporting ring 3-1, and the spring seat 3-3 is secured to one end of the cantilever 3-2. The first shaft 8-2 is disposed on the spring seat 3-3. The spring seat 3-3 is covered by a sealing cover 4, thereby preventing the spring seat from being blocked by dirt. The reset member 8 adopts a spring mechanism, and the elastic resilience of the spring is the driving force to open and close the floor drain.

Figure 8A:
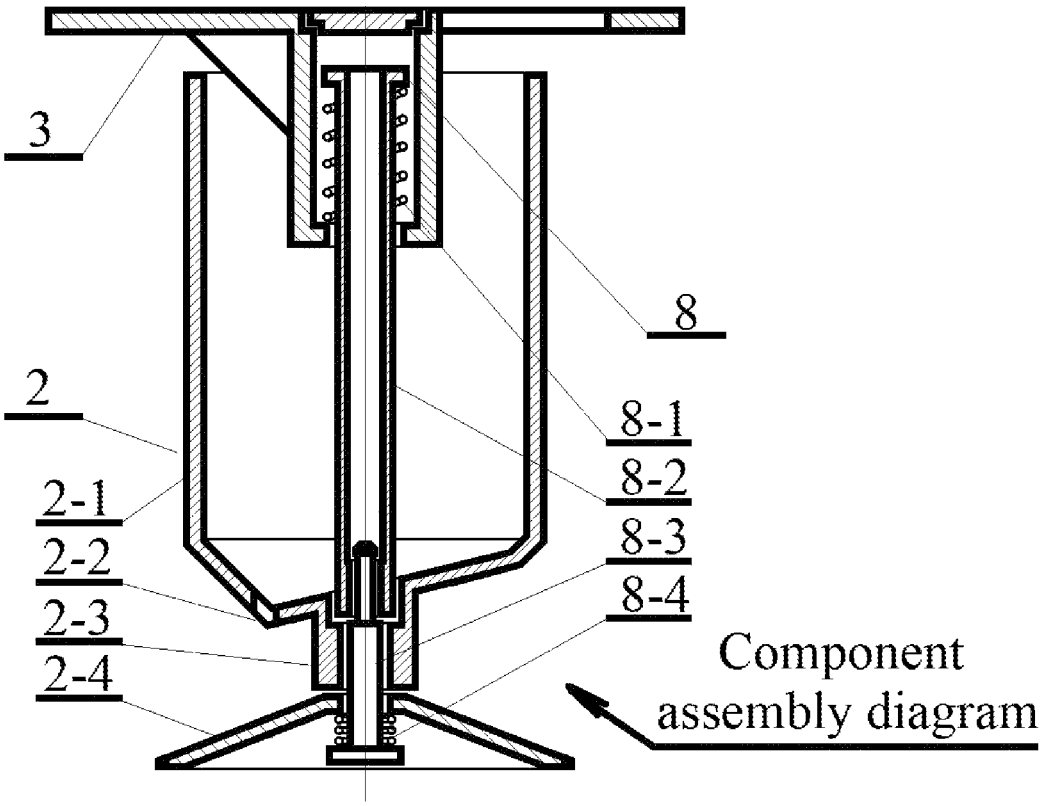
FIG. 8A is an assembly diagram of a supporting frame and a reset member according to one embodiment of the disclosure.
Figure 8B:
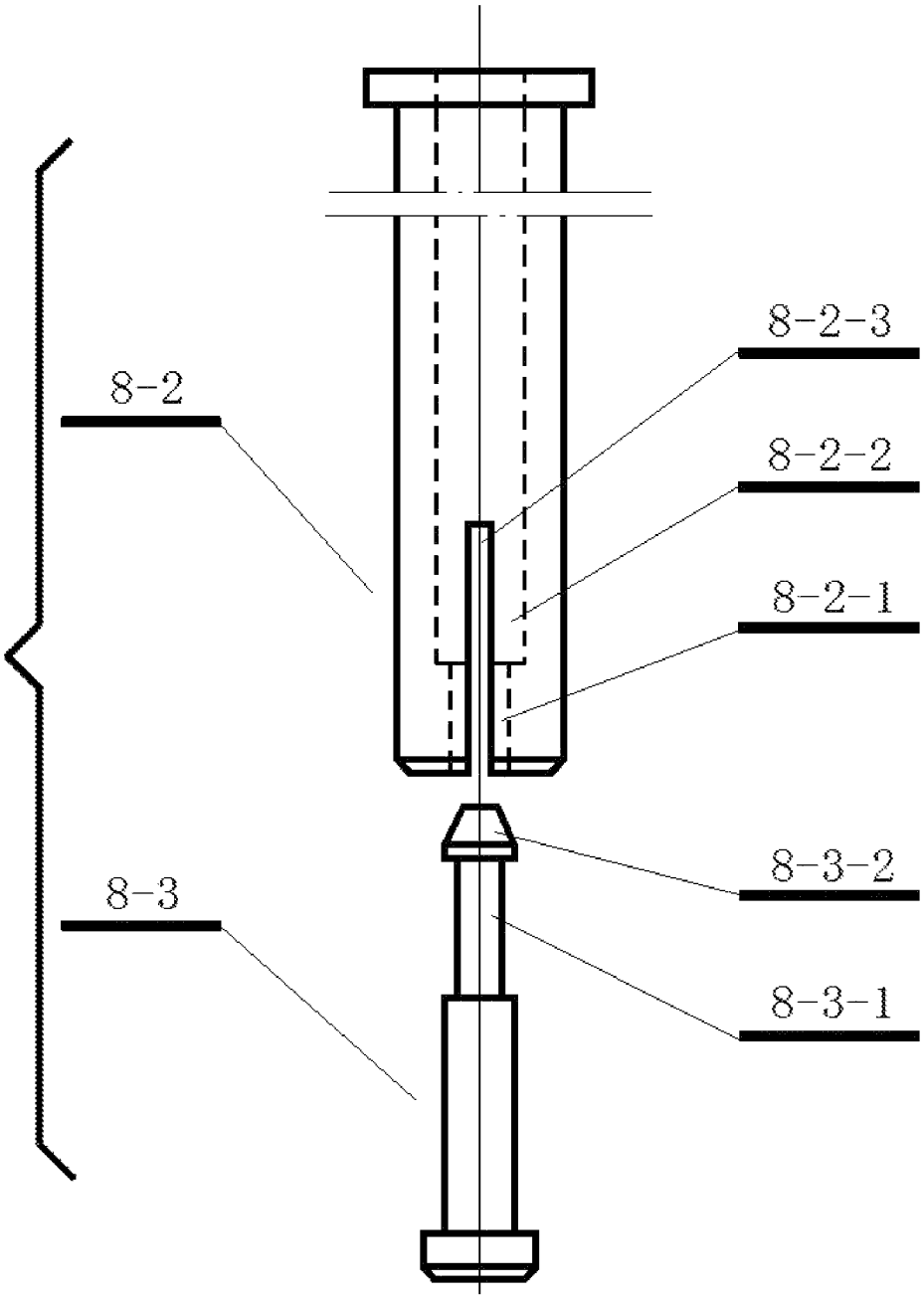
FIG. 8B is a schematic diagram of a driving shaft of the reset member.

The first shaft 8-2 is connected to the second shaft 8-3 using a buckle structure as shown in FIG. 8B. The lower end of the cup body 2-1 comprises a sleeve 2-1-0 shown in FIG. 9B to strengthen the connection of the first shaft 8-2 and the second shaft 8-3. The second spring 8-4 presses the base 2-4 to tightly contact the lower end of the drain body 1, thereby improving the sealing performance of the floor drain.

Referring to FIG. 8A, the drain cup 2 is fixedly disposed on the driving shaft passing through the axis of the drain cup 2. The driving shaft comprises the first shaft 8-2 comprising a female fastener disposed on one end of the first shaft, and the second shaft 8-3 comprising a male fastener disposed on one end of the second shaft. Referring to FIG. 8B, the female fastener comprises a clamping portion 8-2-1, a counterbore portion 8-2-2 and a narrow groove 8-2-3. The male fastener comprises a connection rod 8-3-1 and a connector 8-3-2. The connector is slidable along the surface of the female fastener and is inserted into the clamping portion 8-2-1. In the process of assembly of the driving shaft, the male fastener of the second shaft 8-3 is inserted into the female fastener of the first shaft 8-2. The female fastener is opened due to elastic deformation. After the male fastener is pressed into the female fastener, the male fastener fits with the female fastener, and the female fastener is elastically reset and locked. The male fastener can a material selected from plastic and metal.

Figure 9A:
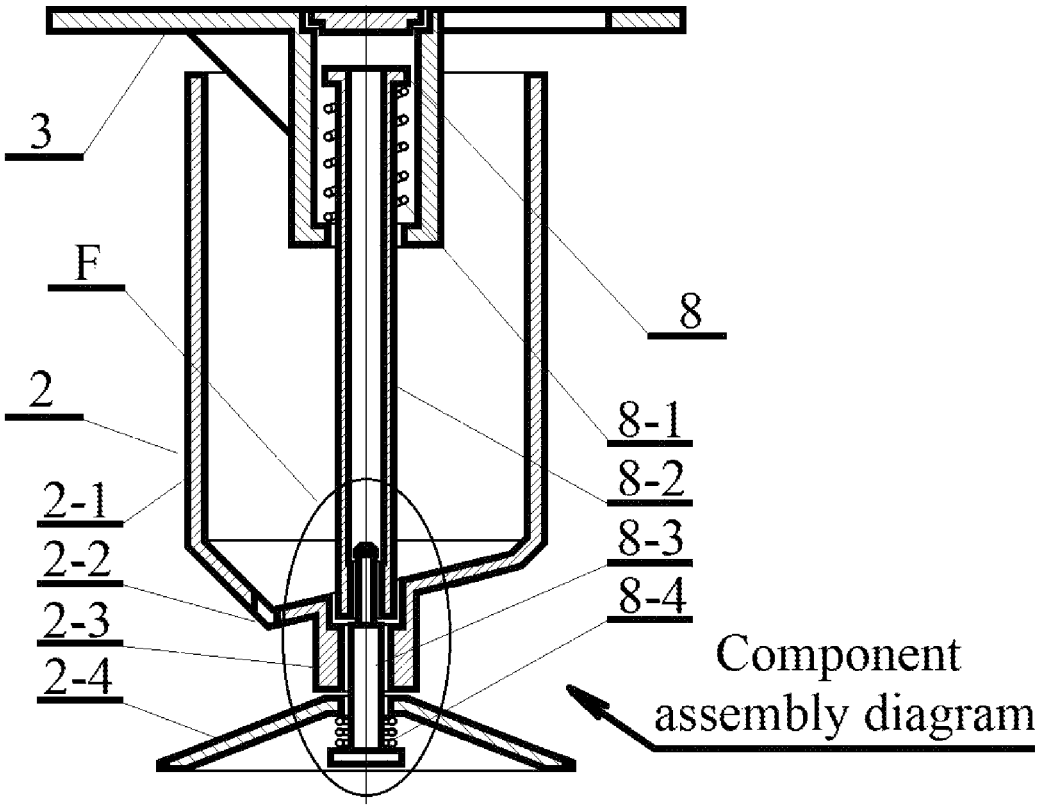
FIG. 9A is an assembly diagram of a drain cup, a supporting frame and a reset member according to one embodiment of the disclosure.
Figure 9B:
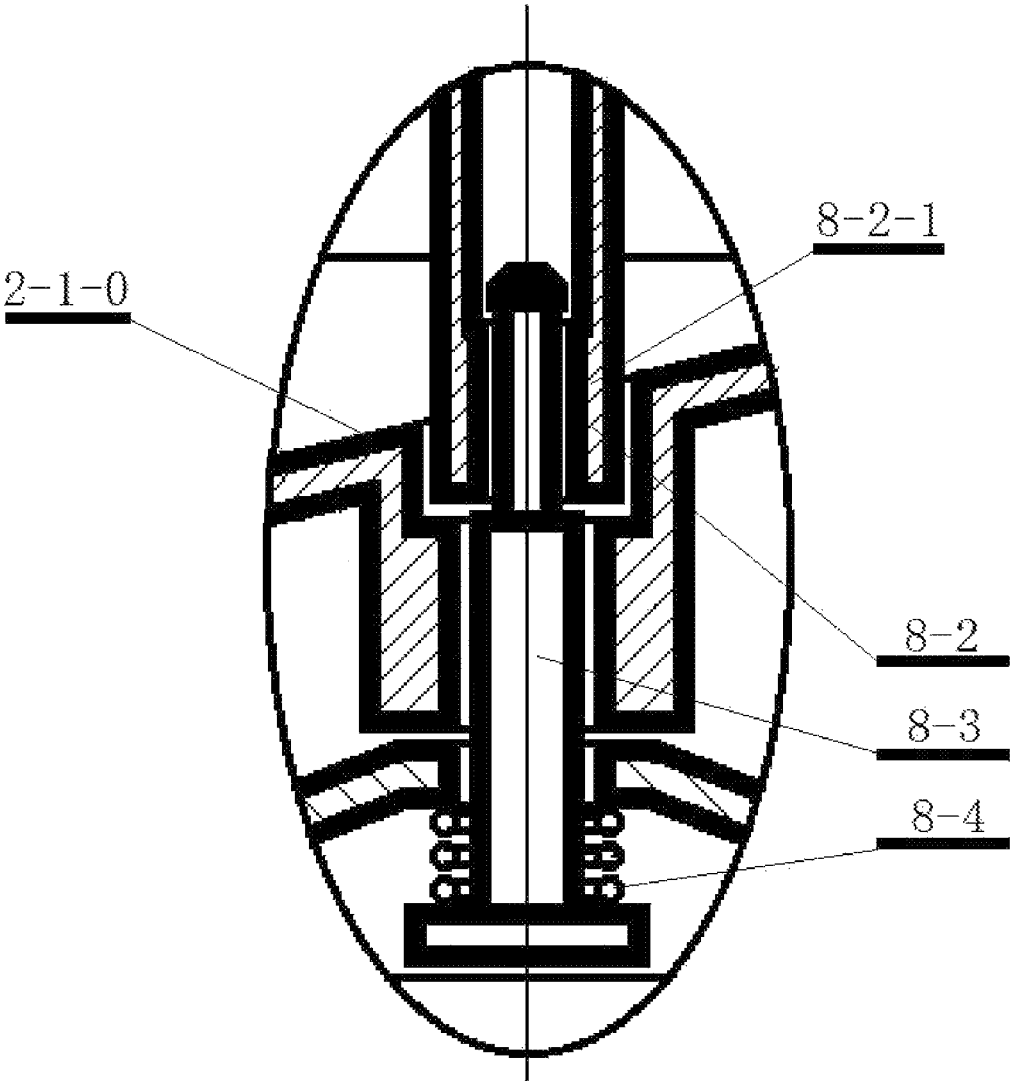
FIG. 9B is a local enlarged view of part F in FIG. 9A.

Optionally, referring to FIG. 9B, provided is another connection mode of the first shaft and the second shaft, where a sleeve 2-1-0 is disposed on the lower end of the cup body 2-1. The lower end of the first shaft 8-2 is a female fastener and the upper end of the second shaft 8-3 is a male fastener comprising a connection rod and a connector. In the process of assembly of the driving shaft, when the male fastener of the second shaft 8-3 is inserted into the female fastener of the first shaft 8-2, the clamping portion 8-2-1 is opened. The sleeve 2-1-0 disposed on the lower end of the cup body 2-1 does not hinder the connection of the first shaft 8-2 and the second shaft 8-3. After the male fastener is completely pressed into the female fastener, the clamping portion 8-2-1 is closed, and the second spring 8-4 wrapped around the second shaft 8-3 stretches to drive the sleeve 2-1-0 to surround the clamping portion 8-2-1, thus locking the female fastener.

In certain embodiments of the disclosure, the supporting frame 3 is integrated with the drain body 1 to form an integrated structure. The integrated structure is rotatably removably fixed on the drain base 6, thus facilitating the cleaning of the supporting frame and the drain body.

Figure 10:
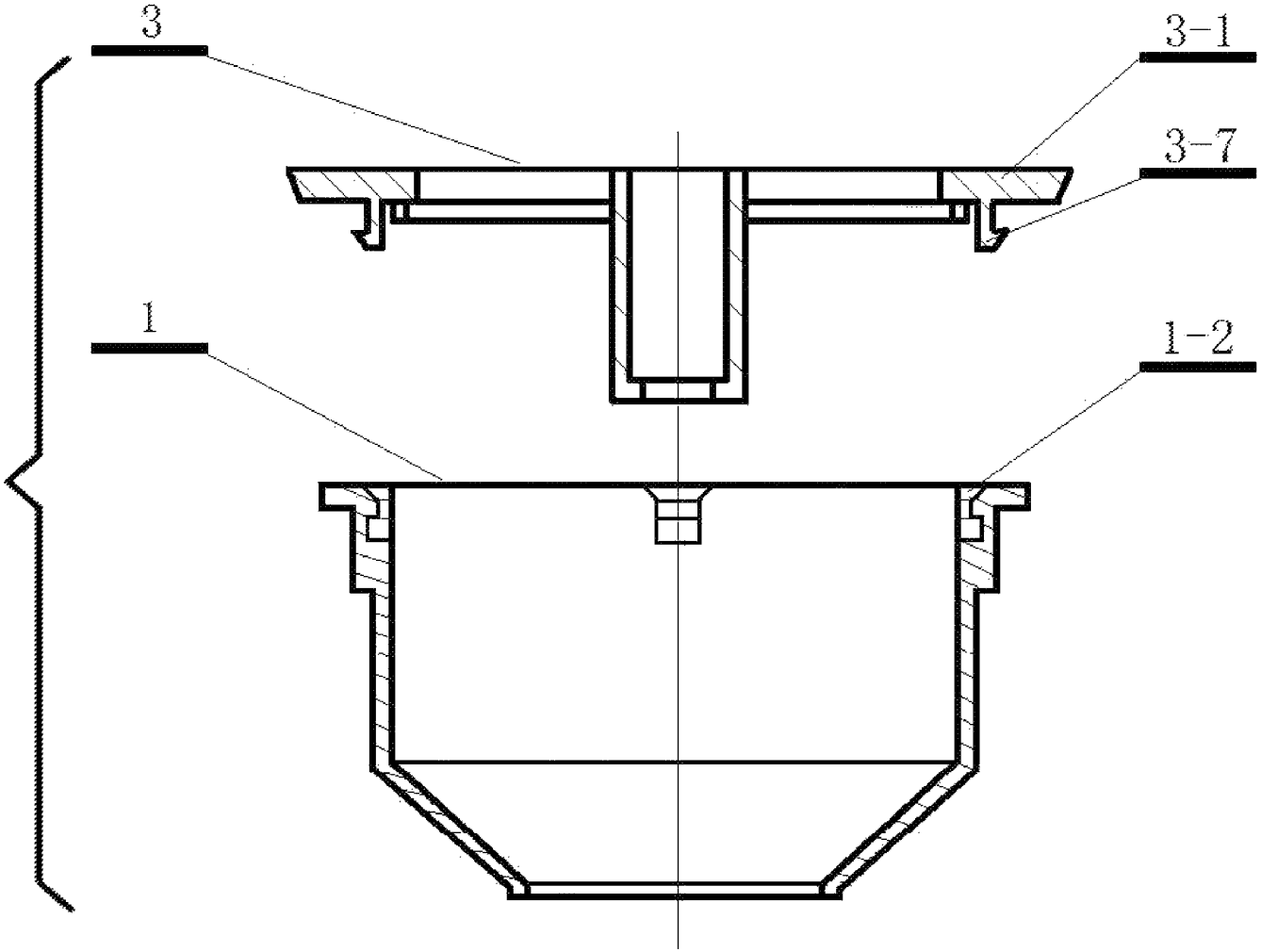
FIG. 10 is a schematic diagram of a supporting frame comprising a hanging hook according to one embodiment of the disclosure.

Referring to FIG. 10, the supporting frame 3 comprises a plurality of circumferentially disposed hanging hooks 3-7. The drain body 1 comprises a plurality of mounting holes 1-2 cooperating with the hanging hooks 3-7. The plurality of hanging hooks is deformable and can be respectively pressed into the plurality of mounting holes. After the plurality of hanging hooks is respectively pressed into the plurality of mounting holes, the plurality of hanging hooks recovers to its original formation and is locked in the mounting holes, thereby locking the supporting frame 3 and the drain body 1 together.

Figure 11A:
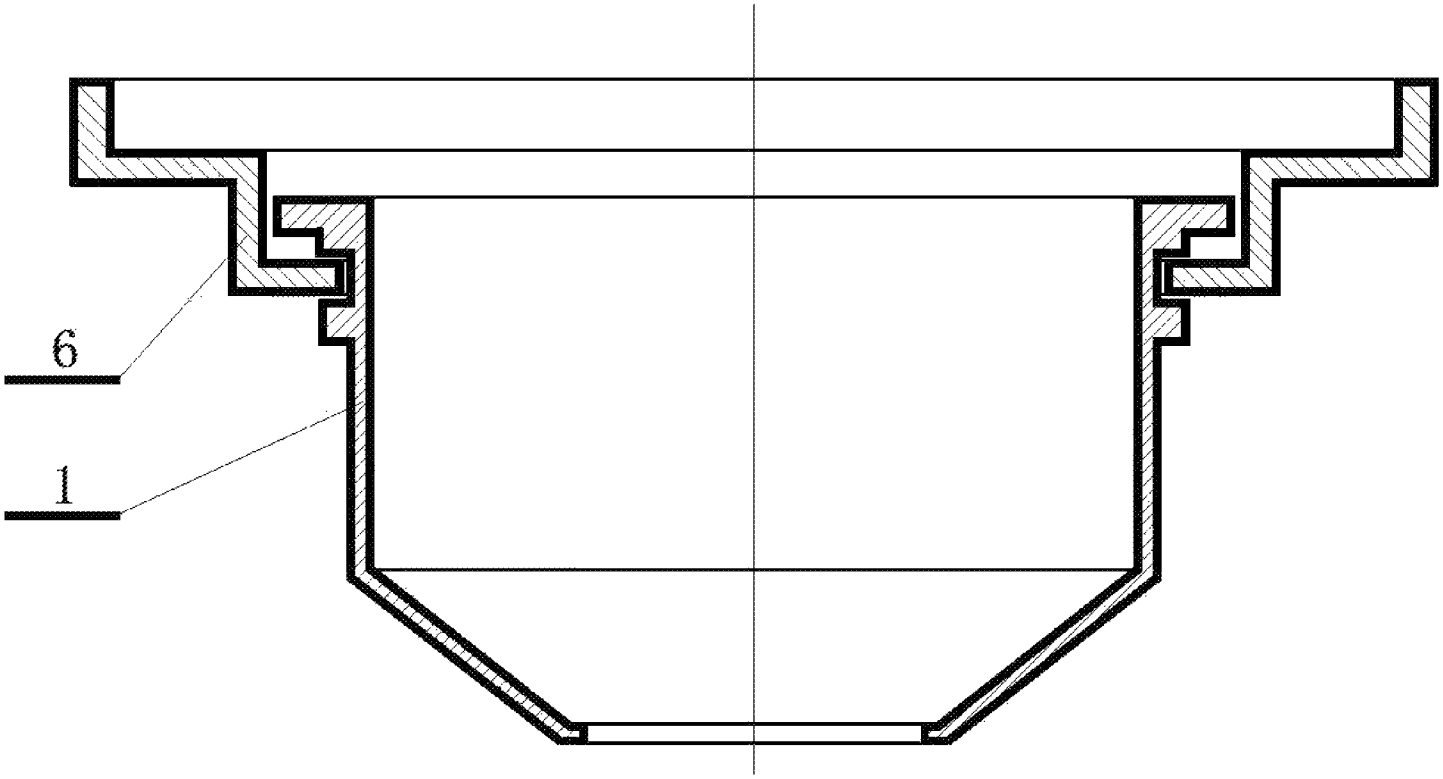
FIG. 11A is a connection diagram of a drain body and a drain base according to one embodiment of the disclosure.
Figure 11B:
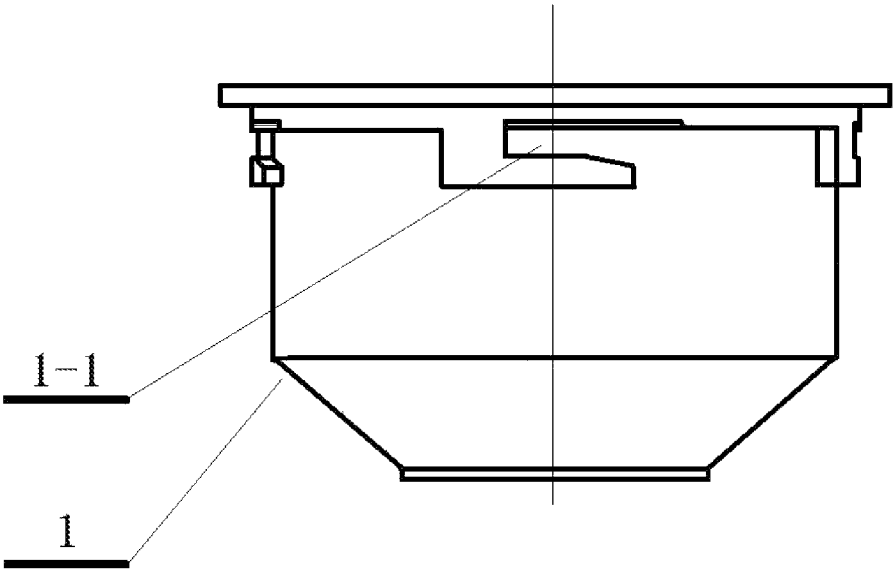
FIG. 11B is a schematic diagram of a drain body comprising a slot.
Figure 11C:
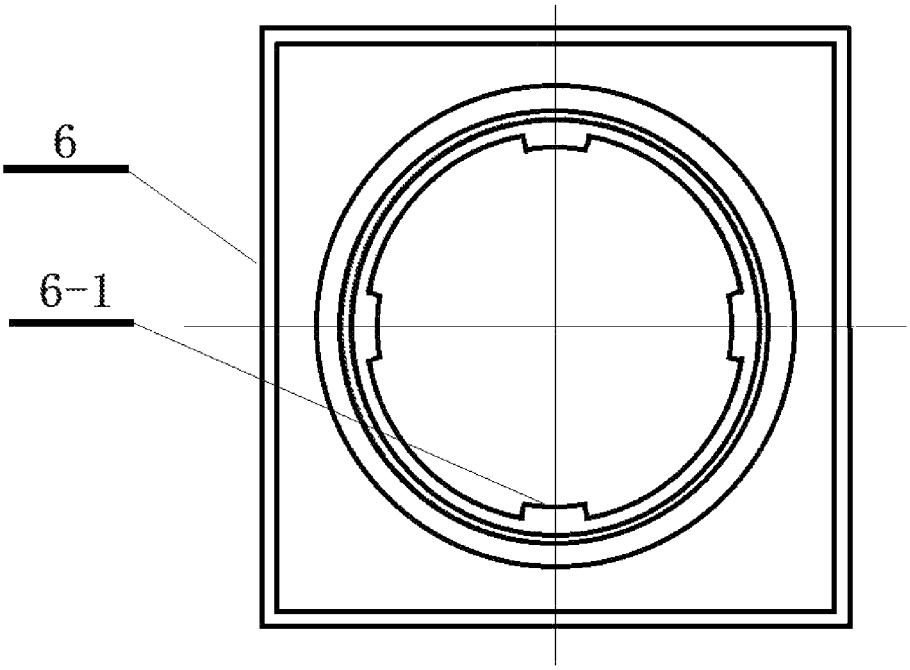
FIG. 11C is a schematic diagram of a drain base comprising a lug.

Optionally, referring to FIG. 11, provided is another connection mode of the drain body 1 and the drain base 6. The drain base 6 comprises a plurality of circumferentially disposed lugs 6-1. The drain body 1 comprises a plurality of circumferentially disposed slots 1-1 corresponding to the plurality of lugs 6-1. When the drain body 1 is secured to the drain base 6, the plurality of circumferentially disposed lugs 6-1 is flush with the plurality of circumferentially disposed slots 1-1. The drain body 1 is rotatable with respect to the drain base 6. Rotate the drain body, so that the plurality of lugs 6-1 is respectively embedded in the plurality of slots 1-1, thus securing the drain body to the drain base 6.

Figure 12A:
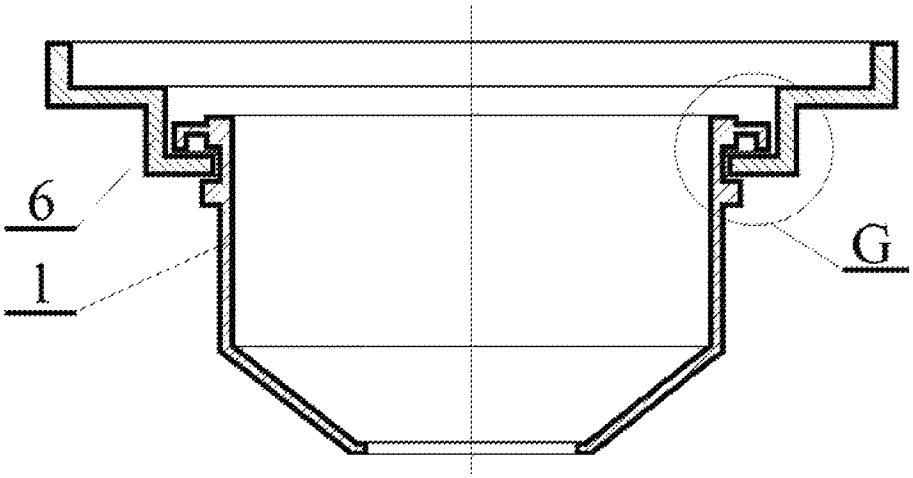
FIG. 12A is a connection diagram of a drain body and a drain base according to another embodiment of the disclosure.
Figure 12B:
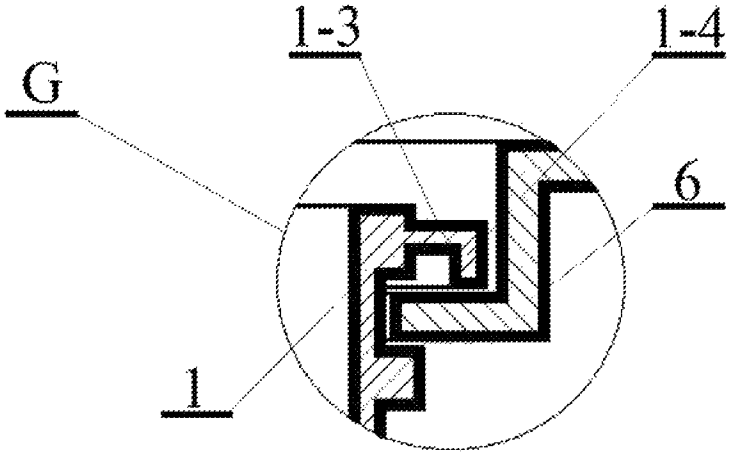
FIG. 12B is a schematic diagram of a drain body comprising a pressure plate.

FIG. 12A-12B show a sealing mode of the drain body 1 and the drain base 6 in accordance with certain embodiments of the disclosure. FIG. 12A is a local enlarged view of part G of FIG. 12A. The drain body 1 comprises an outer edge provided with a pressure plate 1-3. One end of the pressure plate 1-3 is provided with a sealing ring 1-4; and the sealing ring 1-4 is in a sealed connection to the drain base 6. The pressure plate 1-3 is an elastic material such as plastic. The drain body 1, the pressure plate 1-3 and the sealing ring 1-4 can be one-step formed and molded through an injection molding process. When the supporting frame 3 is integrated with the drain body 1, the supporting frame 3 can be regarded as an extension of the drain body 1, and the sealing ring 1-4 can be integrated with the supporting frame 3. The connection mode of the drain body 1 and the drain base 6 omits the sealing rubber ring in the related art.

Figure 14:
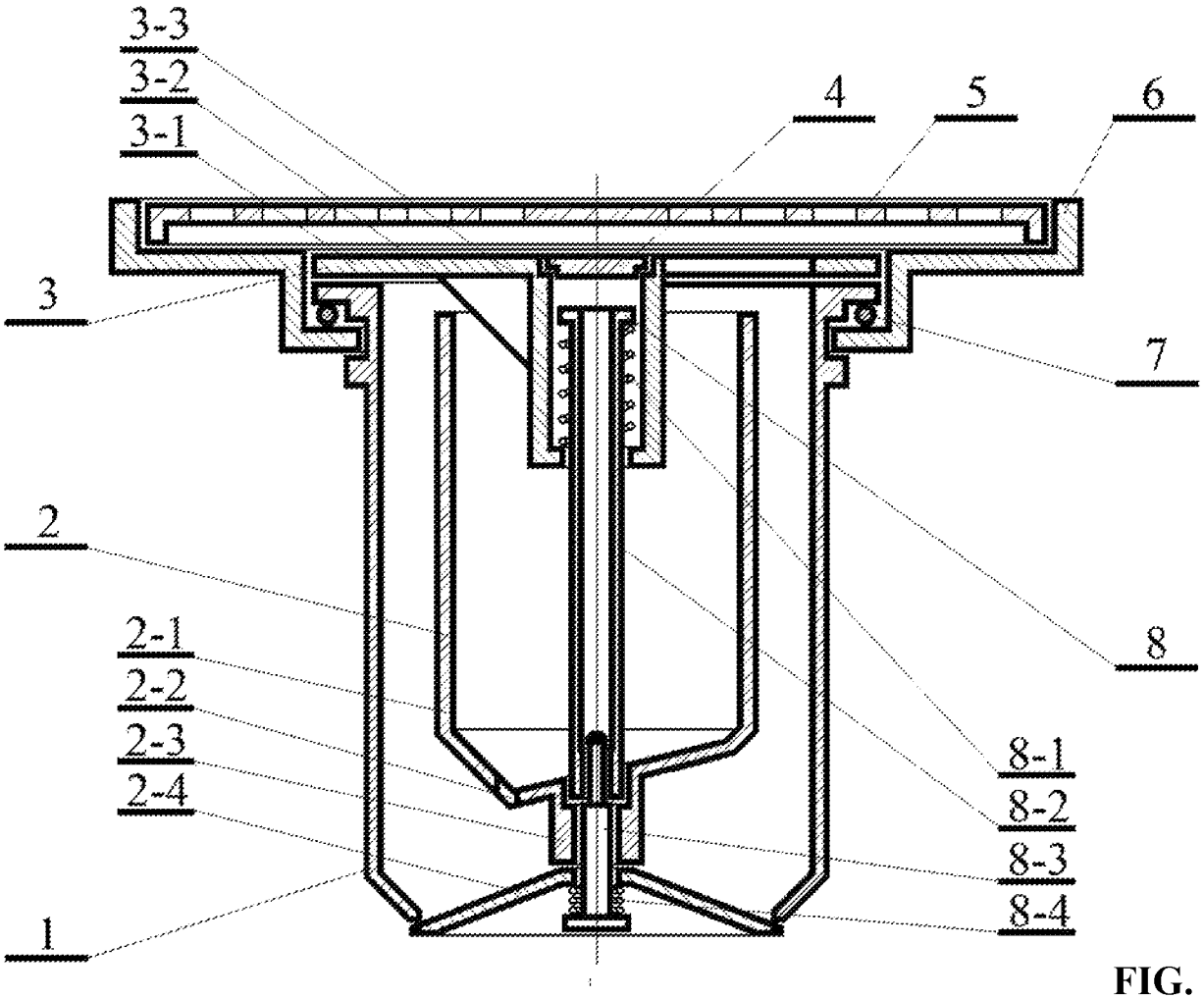
FIG. 14 is a schematic diagram of a floor drain according to one embodiment of the disclosure.

In certain embodiments of the disclosure, as shown in FIG. 14, the cup body 2-1 has an outer diameter of 30 mm, and the drain body 1 can be inserted into a vertical drainage pipe having a nominal diameter of 50 mm. The water enters the grate 5, flows through the drain base 6 and the supporting ring 3-1, down through the annular channel, and out of the drainage outlet. The water flows into the cup body 2-1 via the through hole 2-2 and the opening of the cup body, and accumulates in the cup body 2-1. When the cup body 2-1 is filled with water, the floor drain is opened under the weight of the water. As shown in FIG. 14, the supporting frame 3 comprises no guide plate, and thus the flow area of the water inlet is increased in comparison to a floor drain having a guide plate, thereby effectively improving the drainage capacity of the floor drain.

Figure 1B:
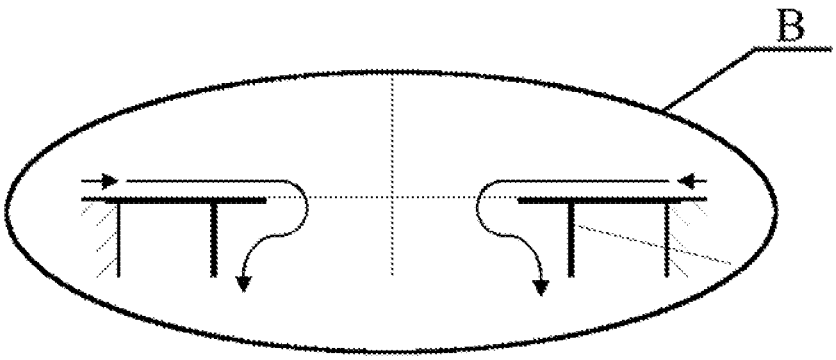
FIG. 1B (Prior art)
FIG. 1B is a schematic diagram showing a waterflow direction of a floor drain with a guide plate in the related art.

FIG. 1 shows a floor drain comprising no guide plate. When the floor drain is closed, the inner surface of the drain body 1, the outer surface of the cup body 2-1, the upper surface of the base 2-4 and the stem 2-3 form a water storage tank. When the water falls into the closed floor drain, the water first flows into the water storage tank. The weight of the accumulated water is exerted on the reset member 8, and its value is approximately equal to the product of the static pressure of the accumulated water and the area of the drainage outlet. The downward force acting on the reset member 8 increases with the increase of the water level in the water storage tank. When the downward force reaches the threshold value for opening the reset member, the floor drain is opened and the water flows into the annular channel and out of the drainage outlet.

The water inlet is not provided with a guide plate, so the water from the ground directly vertically falls into the annular channel, thus reducing the flow resistance of the water.

When the floor drain is closed, the water flows into the water storage tank, accumulates in the water storage tank, and enters the cup body 2-1 via the through hole 2-2. When the water storage tank is filled with water up to a certain height, the reset member is pressed to open the drainage outlet. A relatively small-sized through hole 2-2 keep adequate quantity of water in the cup body 2-1. For a floor drain comprising a cup body with a small opening, the drainage capacity is subject to the area of the water inlet and the flow resistance. Thus, the arrangement of the through hole can maintain the opening state of the floor drain, and increases the drainage capacity of floor drain.

The flow area of the drainage outlet is larger than that of the inlet of the annular channel. The flow area, as shown in FIG. 3, is a cross-sectional area of the annular channel perpendicular to the wall of the drain body 1.

Figure 3:
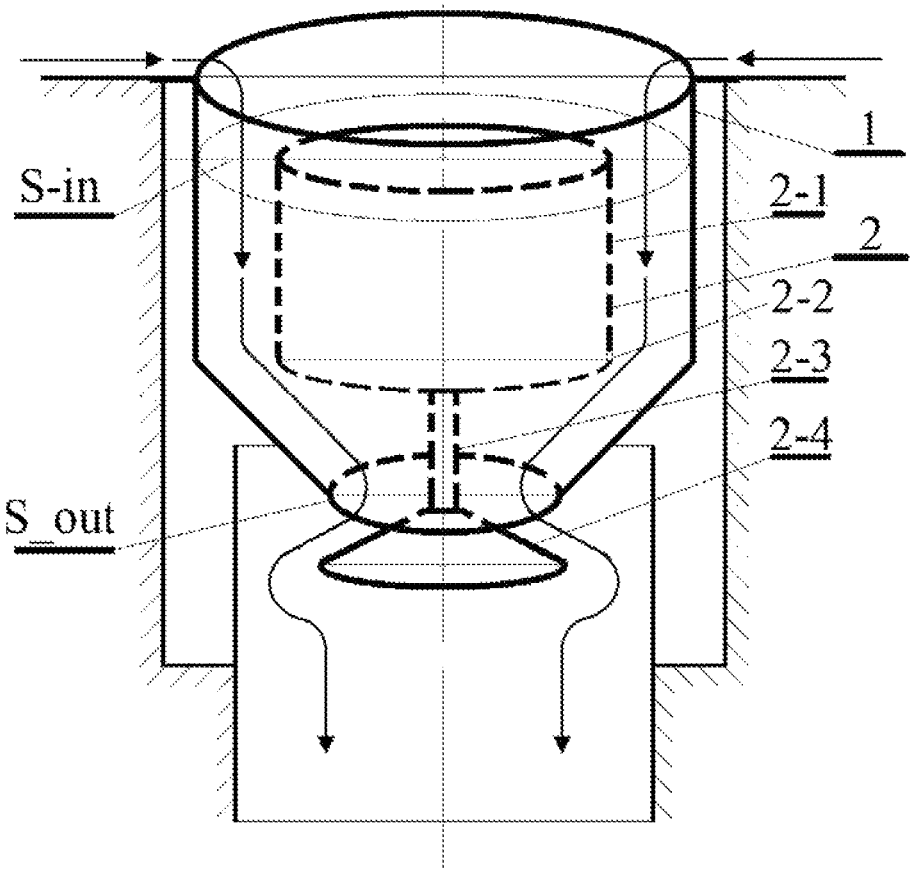
FIG. 3 is a schematic diagram of a floor drain according to another embodiment of the disclosure.

Referring to FIG. 3, when the floor drain is opened, the water flows into the annular channel and drains out of the drainage outlet. S-in refers to the cross section of the water inlet of the annular channel, and S-out refers to the cross section of the water outlet of the annular channel. The area of the cross-section S-in is less than that of the cross-section S-out. When the flow area of the gap between the lower end of the drain body 1 and the upper surface of the base 2-4 is greater than the area of the cross-section S-out, the flow area of the water inlet of the annular channel is minimal from the water inlet to the water outlet of the annular channel. The annular channel will not be completely filled with water and also contains a certain amount of gas, effectively reducing the upward buoyant exerting on the cup body, increasing the downward force exerting on the drain cup, and improving the stability and the drainage capacity of the floor drain.

The reset member 8 comprises a spring mechanism, and the supporting frame 3 is supported via the cantilever. A sealing rubber ring 7 is disposed between the drain body and the drain base 6 to prevent the leakage of odor in the drainage pipe.

It will be obvious to those skilled in the art that changes and modifications may be made, and therefore, the aim in the appended claims is to cover all such changes and modifications.

What is claimed is:

1. A device, comprising:

a drain base adapted to be fixed on a floor;

a drain body comprising an upper end, a lower end, and a cavity;

a drain cup, the drain cup comprising a cup body, a stem, and a base;

a supporting frame; and a reset member;

wherein:

the upper end of the drain body is integrated with the drain base, or is detachably connected to the drain base;

the cup body comprises a lower end provided with a through hole;

and the stem is disposed between the cup body and the base and connected to the cup body;

the cup body, the stem, and the base are fixed on the reset member;

the cup body is disposed in the cavity;

a space between the drain body and the drain cup forms an annular channel, and the annular channel communicates with the through hole;

the annular channel comprises a water inlet and a water outlet; the water outlet is a drainage outlet disposed on the lower end of the drain body;

the base is adapted to open or close the drainage outlet;

the supporting frame is connected to the upper end of the drain body and the reset member;

the drain cup is supported by the supporting frame via the reset member;

the drain cup and the reset member are movable with respect to the supporting frame for opening or closing the water outlet;

the annular channel or the cup body is adapted to collect water from the floor; and when water enters the device, the annular channel or the cup body collect water from the floor, and the drain cup and the reset member are driven to move by the gravity of the water collected in the annular channel or the cup body for automatically opening the water outlet.

2. The device of claim 1, wherein the stem is a hollow sleeve pipe.

3. The device of claim 1, wherein the cup body comprises a straight part and a contraction part disposed between the straight part and the stem, and a diameter of the contraction part decreases along an axial direction of the drain cup extending from the cup body to the base.

4. The device of claim 1, wherein a vertical projected area of the cup body is greater than a vertical projected area of the base.

5. The device of claim 1, wherein a flow area of the water outlet is greater than that of the water inlet of the annular channel; and the flow area of the water outlet/inlet refers to a cross-sectional area of the annular channel in a horizontal direction.

6. The device of claim 5, wherein the flow area of the water outlet is greater than that of any other part of the annular channel.

7. The device of claim 5, wherein when the cup body is filled with water, the flow area between the drain body and the base is greater than the flow area of the water outlet.

8. The device of claim 1, wherein the cup body comprises a first straight part and a first contraction part disposed between the straight part and the stem;

the drain body comprises a second straight part parallel to the first straight part and a second contraction part parallel to the second contraction part.

9. The device of claim 1, wherein the supporting frame comprises a guide plate extending out of the cup body to guide water into the cup body.

10. The device of claim 9, wherein the guide plate is a grooved guide plate comprising an annular water collector and a guide channel disposed on the annular water collector; the guide channel is disposed above the annular channel to guide the water into the cup body.

11. The device of claim 1, wherein the supporting frame comprises a supporting ring, a cantilever, and a spring seat; the spring seat is secured to one end of the cantilever; the cantilever is connected to the supporting ring; and the reset member is supported by the cantilever.

12. The device of claim 1, wherein the reset member comprises a first spring, a second spring, and a driving shaft; and the drain cup is fixed on the driving shaft.

13. The device of claim 12, wherein the driving shaft comprises a first shaft and a second shaft; the first shaft comprises a female fastener and the second shaft comprises a male fastener; and the male fastener is secured to the female fastener thereby integrating the first shaft and the second shaft.

14. The device of claim 13, wherein the first spring is wrapped around the first shaft, and the second spring is wrapped around the second shaft; the cup body further comprises a sleeve, when the first shaft is integrated with the second shaft, the sleeve is wrapped around the female fastener.

15. The device of claim 1, wherein the supporting frame comprises a plurality of circumferentially disposed hanging hooks.

16. The device of claim 15, wherein the supporting frame comprises four circumferentially disposed hanging hooks, and the drain base comprises four mounting holes receiving the four hanging hooks, respectively.

17. The device of claim 1, wherein the drain base comprises a plurality of circumferentially disposed lugs, and the drain body comprises a plurality of circumferentially disposed slots; and the plurality of circumferentially disposed lugs is respectively disposed in the plurality of circumferentially disposed slots.

18. The device of claim 1, wherein the drain body comprises an outer edge provided with a pressure plate; one end of the pressure plate is provided with a sealing ring; and the sealing ring is in a sealed connection to the drain base.

* * * * *